US005168856A

United States Patent [19]

Lorraine

[11] Patent Number: 5,168,856

[45] Date of Patent: Dec. 8, 1992

[54] PLASTIC FUEL RAIL HAVING INTEGRAL GUARD WALL FOR PROTECTING AN INTEGRAL NIPPLE OR HOSE BARB

[75] Inventor: Jack R. Lorraine, Newport News, Va.

[73] Assignee: Siemens Automotive L.P., Auburn Hills, Mich.

[21] Appl. No.: 819,048

[22] Filed: Jan. 10, 1992

[51] Int. Cl.[5] ..... F02M 55/02

[52] U.S. Cl. ..... 123/468; 123/456; 285/27; 285/305

[58] Field of Search ..... 123/468, 469, 470, 472, 123/456; 285/24, 27, 32, 33, 222, 242, 156, 305

[56] References Cited

U.S. PATENT DOCUMENTS

| | | | |
|---|---|---|---|
| 2,317,929 | 4/1943 | Bruno | 285/27 |
| 4,510,909 | 4/1985 | Elphick | 123/470 |
| 4,586,477 | 5/1986 | Field | 123/468 |
| 4,688,829 | 8/1987 | Shioda | 285/305 |
| 4,922,958 | 5/1990 | Lemp | 123/456 |
| 5,002,030 | 3/1991 | Mahnke | 123/468 |
| 5,022,355 | 6/1991 | Billingsley | 123/468 |
| 5,046,765 | 9/1991 | Usui | 285/156 |
| 5,056,489 | 10/1991 | Lorraine | 123/456 |
| 5,076,242 | 12/1991 | Parker | 123/468 |
| 5,092,300 | 3/1992 | Imoehl | 285/305 |

*Primary Examiner*—Carl S. Miller

*Attorney, Agent, or Firm*—George L. Boller; Russel C. Wells

[57] ABSTRACT

A plastic fuel rail that serves fuel injectors of an internal combustion engine has integral hose barbs that provide for the push-on connection of corresponding cross-over tubes. The hose barbs are protected against lateral impacts by integral guard walls extending from the fuel rail parallel to and spaced from the hose barbs. Several guard wall embodiments are disclosed.

13 Claims, 2 Drawing Sheets

PLASTIC FUEL RAIL HAVING INTEGRAL GUARD WALL FOR PROTECTING AN INTEGRAL NIPPLE OR HOSE BARB

FIELD OF THE INVENTION

This invention relates to fuel rail assemblies for internal combustion engines, especially those which have plastic fuel rails containing integral nipples, or hose barbs, that provide for the connection of fuel tubes to the fuel rail.

BACKGROUND AND SUMMARY OF THE INVENTION

Certain fuel rail assemblies for V-type engines comprise two main fuel rail tubes, one for each bank of cylinders, fluidly coupled by one or more cross-over tubes. When such main fuel rail tubes are rigid metal and such cross-over tubes are flexible synthetics, a common practice for connecting the cross-over tubes to the main fuel rail tubes is to attach metal nipples or hose barbs to the main fuel rail tubes and to push the ends of the cross-over tubes over the nipples or hose barbs in a telescopic manner. Because a hose barb is serrated, its serrations will embed themselves in the inner wall of the cross-over tube to seat and retain the cross-over tube in place. A retention band, of any conventional type, may be placed around the connection, as required.

When such main fuel rail tubes are rigid plastic, it becomes possible to form the nipples or hose barbs integrally therewith so that steps of separately fabricating the main fuel rails and the nipples or hose barbs and then assembling the nipples or hose barbs to the main fuel rails, can be avoided.

From the standpoint solely of hydraulic flow considerations, the cross sectional flow area through a nipple or hose barb and that through the cross-over tube connected to it can be equal. In reality however, they cannot be equal because the wall of the nipple or hose barb would otherwise have zero thickness. While the walls of the cross-over tube and of the nipple or hose barb must obviously have certain respective minimum thicknesses, the greater the sum of those thicknesses, the greater the disparity between the flow area through the nipple or hose barb on the one hand and the inside and outside diameters of the cross-over tube on the other hand. Thus, it becomes desirable to minimize the wall thicknesses of the nipple or hose barb and of the cross-over tube as much as possible, consistent with other design considerations and specifications.

Minimizing the wall thickness of a nipple or hose barb will, for a given wall thickness of the cross-over tube, minimize the amount of material required for the cross-over tube, and since the cross-over tube is apt to be considerably longer than the nipple or hose barb, material savings in the cross-over tube accrue by minimizing the wall thickness of the nipple or hose barb. However, too thin a wall for the nipple or hose barb, even if otherwise suitable for the fluid pressures involved, may not be sufficiently strong to withstand accidental, externally applied, side (lateral) impacts greater than a certain force magnitude, and therefore designing a nipple or hose barb so that it can withstand side impacts less than or equal to such a force magnitude will also cause an increase in the amount of material used in the cross-over tube.

The present invention relates to an improvement which is capable of providing protection for such a nipple or hose barb so that for side impact forces below a certain magnitude, the nipple or hose barb can be protected without the consequence of having to increase the size of the cross-over tube connected to it. Briefly, the invention comprises a guard wall that is integral with and projects from the plastic main fuel rail tube immediately adjacent the integral nipple or hose barb so as to laterally guard the nipple or hose guard. Thus, a lateral impact that would otherwise strike the nipple or hose barb will strike the guard wall instead, and so by making the guard wall to have sufficient strength to resist a certain magnitude of side impact force, the nipple or hose barb is thereby protected from such a blow. Indeed, the guard wall may be made substantially stronger than the wall of the nipple or hose barb.

Further features, advantages, and benefits of the invention will be seen in the ensuing description and claims which should be considered in conjunction with the accompanying drawings. The drawings illustrate a presently preferred embodiment of the invention according to the best mode contemplated at this time for carrying out the invention.

DESCRIPTION OF THE PREFERRED EMBODIMENT

Figure 1:
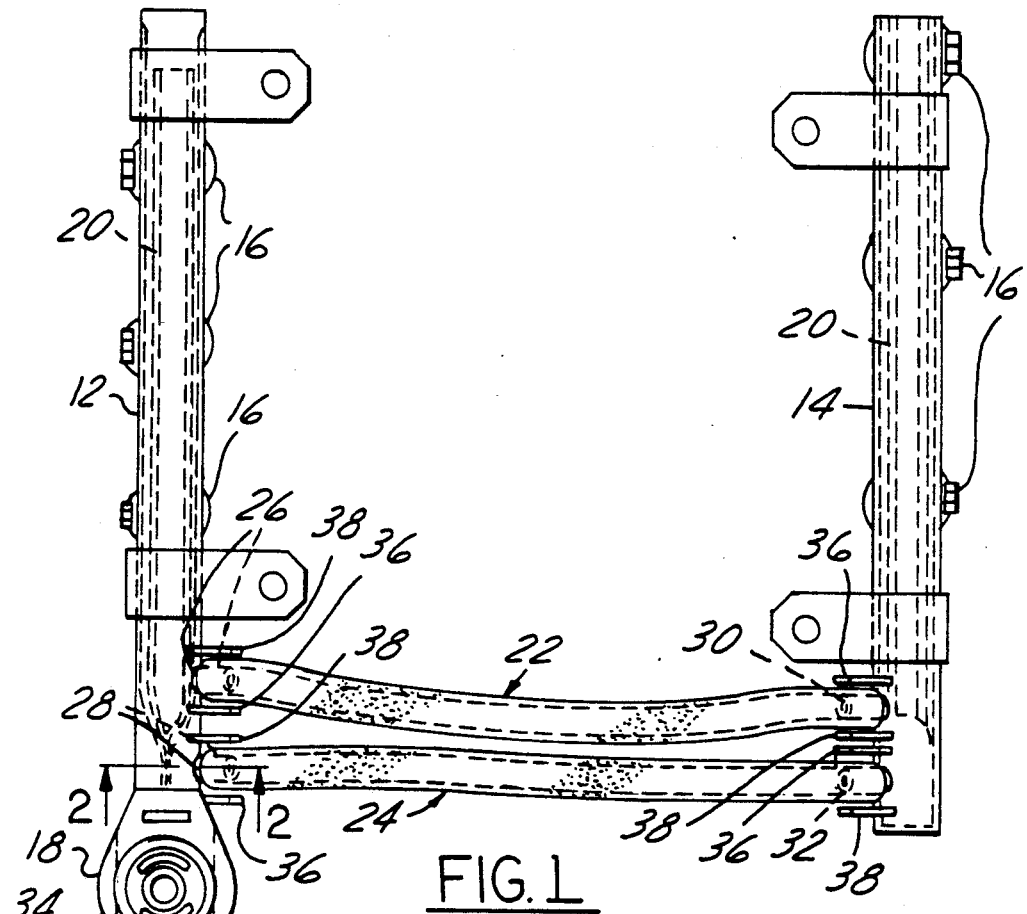
FIG. 1 is a top plan view of an example of a fuel rail assembly embodying principles of the invention.
Figure 2:
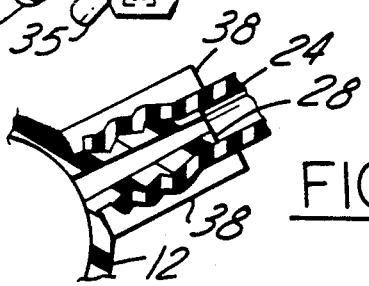
FIG. 2 is a fragmentary cross-sectional view in the direction of arrows 2—2 in FIG. 1 on an enlarged scale.
Figure 3:
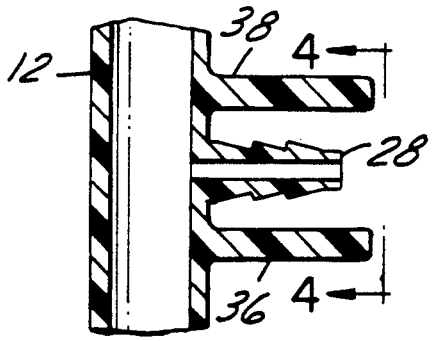
FIG. 3 is a cross-sectional view at right angles to the view of FIG. 2, but omitting the cross-over tube.
Figure 4:
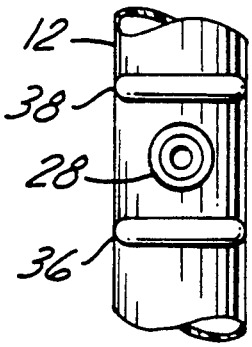
FIG. 4 is a view in the direction of arrows 4—4 in FIG. 3.

The drawing FIGS. 1–4 illustrate a first example of a fuel rail assembly 10 embodying principles of the invention. Fuel rail assembly 10 comprises two main fuel rails 12, 14 that are arranged parallel and spaced apart so as to serve opposite cylinder banks of a V-type spark-ignited internal combustion engine when installed thereon. Each main fuel rail contains several electric-operated fuel injectors 16 at locations along its length, and each fuel injector serves a corresponding cylinder of the engine. Main fuel rail 12 also contains a base 18 for mounting a fuel pressure regulator (not shown).

The example 10 illustrated has a flow path configuration generally like that shown in the inventor's commonly assigned U.S. Pat. No. 5,056,489. Internal baffle structure 20 that extends lengthwise within each main fuel rail 12, 14 provides lengthwise extending passageway structure for fuel to flow lengthwise therein from one end to the other and then return. Two cross-over tubes (conduits) 22, 24 extend between them. Main fuel rail 12 has two hose barbs 26, 28, and main fuel rail 12 also has two hose barbs 30, 32. The ends of tube 22 are telescoped over barbs 26, 30 while the ends of tube 24 are telescoped over barbs 28, 32. An inlet tube 34 delivers fuel to the fuel rail assembly from a fuel supply (not shown), and cross-over tube 24 serves to convey the supply fuel to main fuel rail 14. A return tube 35 conveys return fuel leaving the pressure regulator back to a fuel tank (not shown), and tube 22 serves to convey return fuel from main fuel rail 14 back to the pressure regulator.

The illustrated example 10 differs from that of the patent in that each main fuel rail 12, 14 is plastic and the hose barbs are integrally formed therewith. Such fabrication is accomplished in any conventional manner, such as by injection molding in a suitable mold.

In accordance with principles alluded to earlier, the invention comprises the inclusion of guard walls for the hose barbs. The guard walls are formed integrally with the main fuel rails during the process of fabricating the main fuel rails, i.e. during injection molding, and are in the nature of protruding flanges. The guard wall embodiment of FIGS. 1–4 comprises for each hose barb, two guard wall sections 36, 38, one on either side of the corresponding hose barb. The guard wall sections are arranged parallel and extend beyond the free end of the corresponding hose barb. They are also thicker than the maximum thickness of the corresponding hose barb's wall. They are spaced from the corresponding hose barb a suitable distance to allow the end of the corresponding cross-over tube to fit onto the hose barb without interfering with the guard wall sections.

Figure 5:
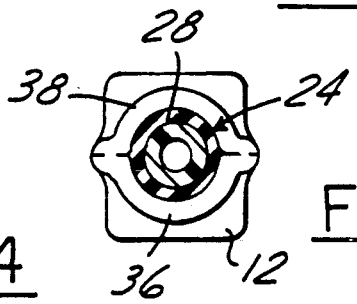
FIG. 5 is a view in the same direction as the view of FIG. 4, but of an alternate embodiment, and includes the cross-over tube.

The embodiment of FIG. 5 shows two guard wall sections 36, 38 that have been re-formed to embrace the end of the cross-over tube 24 after the cross-over tube end has been fitted over the hose barb 28. The guard wall sections may be re-formed to this shape if the material used to make the main fuel rail is a suitable plastic which can be heated and re-formed. The procedure involves heating the guard wall sections to a softening temperature, then re-forming them to the desired shape by suitably shaped tooling, and then allowing them to re-harden. It can be seen in FIG. 5 that the guard wall sections form as essentially circumferentially continuous guard wall around the two telescoped parts, unlike FIGS. 1–4 in which the guard wall around each hose barb is circumferentially discontinuous.

Figures 6, 7:
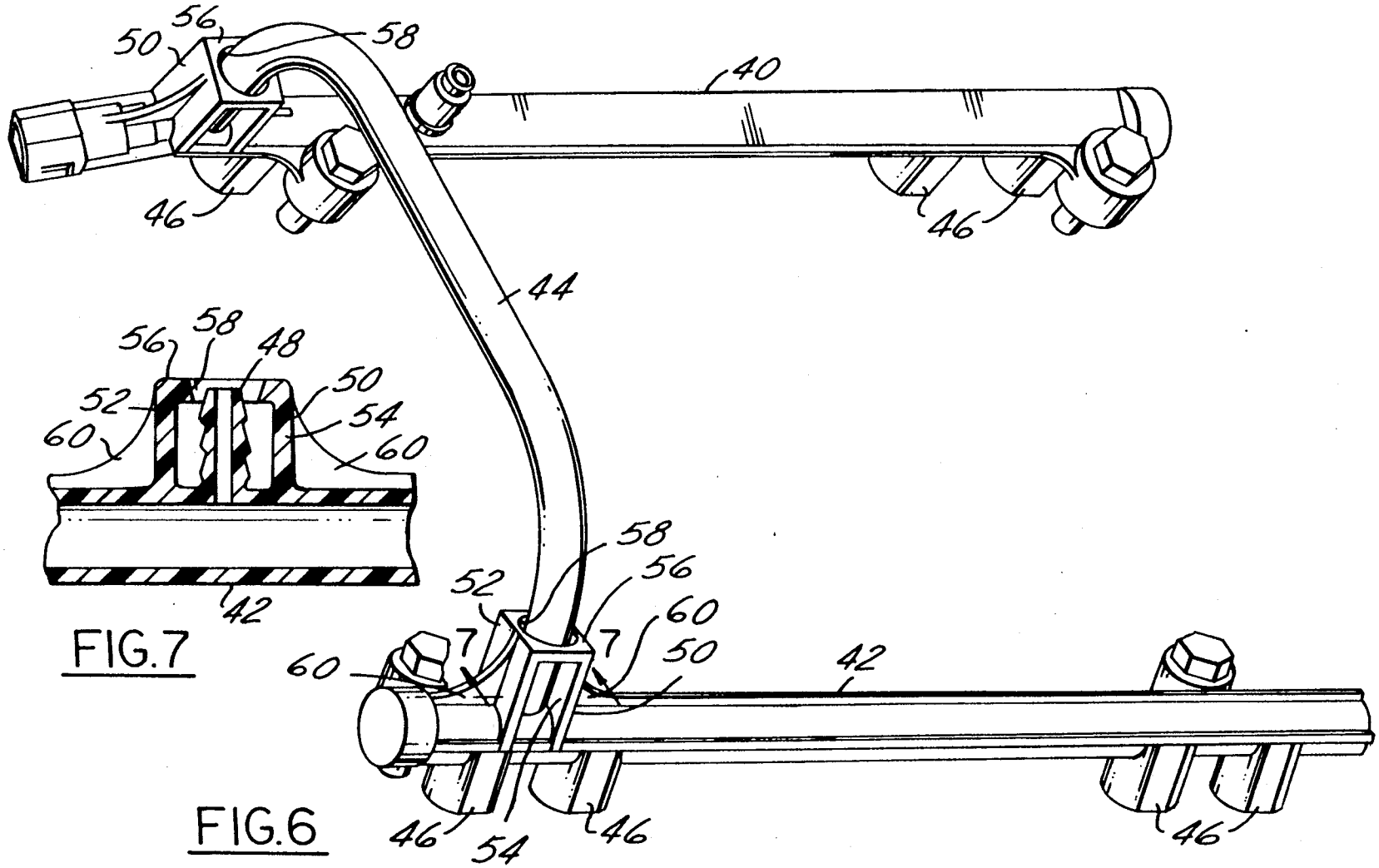
FIG. 6 is a perspective view of another embodiment of fuel rail assembly containing the invention.
FIG. 7 is an enlarged fragmentary cross-sectional view in the direction of arrows 7—7 in FIG. 6.

The fuel rail assembly embodiment of FIGS. 6 and 7 comprises two fuel rails 40, 42 that are fluidly connected by a cross-over tube 44. The fuel injectors are not shown in FIG. 6, but are received in cups 46 of the fuel rails. The fuel rails are fabricated from suitable plastic and include respective integrally-formed hose barbs 48 onto which are telescoped respective ends of cross-over tube 44. Each hose barb 48 is protected by a corresponding guard wall 50.

Each guard wall 50 is formed integrally with the corresponding fuel rail 40, 42 during the process of fabricating the fuel rail, and comprise two guard wall sections 52, 54, one each on diametrically opposite sides of the corresponding hose barb. The guard wall sections are arranged parallel and extend beyond the free end of the corresponding hose barb. They are also thicker than the maximum thickness of the corresponding hose barb's wall. They are spaced from the corresponding hose barb a suitable distance to allow the corresponding end of the cross-over tube to fit onto the hose barb without interfering with the guard wall sections. Additionally, each guard wall 50 comprises a bridging wall 56 which is perpendicular to and bridges the distal ends of its two guard wall sections 52, 54, and which contains a circular hole 58 whose diameter is sufficiently larger than the O.D. of the hose barb so as to allow the hose end to fit onto the barb. Hole 58 has a taper which narrows in the direction toward the corresponding hose barb. Because bridging wall 56 is disposed beyond the distal end of the corresponding hose barb, an appropriate size for its hole 58 will provide a lead for alignment of the end of the tube being telescoped onto the hose barb. Each guard wall 50 further comprises a buttress wall 60 for buttressing each guard wall section 52, 54 in a plane that is perpendicular to the guard wall section on its exterior.

While a presently preferred embodiment of the invention has been illustrated and described, it should be appreciated that principles are applicable to other embodiments. For example, guard walls can be provided to guard nipples or hose barbs that are disposed elsewhere on the exterior of the main fuel rail and/or that are used for connection of fuel tubes other than cross-over tubes. While push-on attachment of tubes to the barbs may be sufficient, separate retention bands or the like may be employed to secure the attachment, and in some instances suitable shaping and sizing of the guard walls will be appropriate for accommodating such devices.

What is claimed is:

1. A fuel rail assembly for an internal combustion engine comprising a main plastic fuel rail member having a fuel passage that extends lengthwise of the member and comprising means adapted to receive and serve fuel to one or more electrically operated fuel injectors disposed along the length of the member, a tube that has fluid communication with said fuel passage and that is integrally formed with said member to project away therefrom on the exterior thereof for telescopically receiving a fuel conduit that is to be connected to it, characterized in that integrally formed with said main fuel rail member is a guard wall projecting away from said member on the exterior thereof immediately adjacent, but spaced from, said tube so as to laterally guard said tube.

2. A fuel rail assembly as set forth in claim 1 characterized further in that said guard wall projects away from said member in the same direction as and beyond said tube.

3. A fuel rail assembly as set forth in claim 1 characterized further in that said guard wall extends essentially circumferentially continuously around said tube.

4. A fuel rail assembly as set forth in claim 1 characterized further in that said guard wall is circumferentially discontinuous around said tube.

5. A fuel rail assembly as set forth in claim 1 characterized further in that said guard wall comprises guard wall sections disposed on diametrically opposite sides of said tube.

6. A fuel rail assembly as set forth in claim 5 characterized further in that said guard wall sections are bridged distally by a bridging section containing a hole that is aligned with said tube but sufficiently larger than said tube to allow for passage therethrough of a fuel conduit for telescoping onto said tube.

7. A fuel rail assembly as set forth in claim 6 characterized further in that said hole has a circular shape and tapers inwardly toward said tube.

8. A fuel rail assembly as set forth in claim 1 characterized further in that a conduit is telescoped onto the outside of said tube and said guard wall embraces said conduit.

9. A fuel rail assembly as set forth in claim 1 characterized further in that said tube comprises a hose barb.

10. A fuel rail assembly as set forth in claim 1 characterized further in that said tube has a wall of certain maximum thickness and said guard wall has a thickness greater than the maximum thickness of the wall of said tube.

11. A fuel rail assembly for an internal combustion engine comprising a main plastic fuel rail member having a fuel passage that extends lengthwise of the member and comprising means adapted to receive and serve fuel to one or more electrically operated fuel injectors disposed along the length of the member, a tube that has fluid communication with said fuel passage and that is integrally formed with said member to project away therefrom on the exterior thereof for telescopically receiving a fuel conduit that is to be connected to it, characterized in that a means is disposed in spaced relation to said tube to provide for alignment of a fuel conduit to said tube prior to telescopic engagement of such a fuel conduit with said tube.

12. A fuel rail assembly as set forth in claim 11 characterized further in that said means comprises a bridging wall integrally formed with the distal end portion of a guard wall that projects away from said member on the exterior thereof immediately adjacent, but spaced from, said tube so as to laterally guard said tube.

13. A fuel rail assembly as set forth in claim 12 characterized further by the inclusion of a buttress wall that is integrally formed with said guard wall and fuel rail to buttress the guard wall on the exterior thereof.

* * * * *